US008479825B2

(12) United States Patent
Childers et al.

(10) Patent No.: US 8,479,825 B2
(45) Date of Patent: Jul. 9, 2013

(54) CRANE DEVICE AND METHOD

(75) Inventors: Leonard Childers, Kingwood, TX (US); John Millican, Spring, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 312 days.

(21) Appl. No.: 12/553,742

(22) Filed: Sep. 3, 2009

(65) Prior Publication Data

US 2011/0048736 A1 Mar. 3, 2011

(51) Int. Cl.
*E21B 7/12* (2006.01)

(52) U.S. Cl.
USPC ..... 166/360; 166/368

(58) Field of Classification Search
USPC ..... 166/85.4, 77.1, 77.51, 360, 368; 175/52, 175/85; 212/178, 307, 180, 309, 204, 223; 251/1.1, 1.3; 248/49, 637; 414/739, 735, 414/729, 22.68, 22.71, 753, 751, 745.1, 730, 414/22.63, 745.2; 294/902, 88; 29/243.53
See application file for complete search history.

(56) References Cited

U.S. PATENT DOCUMENTS

| | | | | |
|---|---|---|---|---|
| 2,450,934 | A * | 10/1948 | Calhoun | 166/77.53 |
| 2,820,377 | A * | 1/1958 | Buck | 408/76 |
| 4,230,190 | A | 10/1980 | Guinn et al. | |
| 4,305,467 | A | 12/1981 | Villines | |
| 5,816,565 | A | 10/1998 | McGuffin | |
| 6,003,598 | A | 12/1999 | Andreychuk | |
| 6,234,253 | B1 | 5/2001 | Dallas | |
| 6,276,450 | B1 | 8/2001 | Seneviratne | |
| 6,712,147 | B2 | 3/2004 | Dallas | |
| 6,719,062 | B2 | 4/2004 | Fikes et al. | |
| 6,902,007 | B1 | 6/2005 | Orr et al. | |
| 7,021,402 | B2 | 4/2006 | Beato et al. | |

(Continued)

FOREIGN PATENT DOCUMENTS

| | | | |
|---|---|---|---|
| JP | 2004250188 | A2 | 9/2004 |
| RU | 2149978 | C1 | 5/2000 |

(Continued)

OTHER PUBLICATIONS

Website: "Articulating Arm Jib Cranes," The On-Line Material Handling Store, Systems Design Incorporated, Downloaded Jun. 4, 2010, http://www.handlingnet.com/store/page8.htm, pp. 1-3.

(Continued)

*Primary Examiner* — Giovanna Wright
*Assistant Examiner* — Ronald Runyan
(74) *Attorney, Agent, or Firm* — Bracewell & Giuliani LLP

(57) ABSTRACT

Method, crane system and crane for moving a component of a device. The crane includes a supporting mechanism configured to be fixedly attached to the device, an arm mechanism connected to the supporting mechanism and configured to move in a horizontal plane, a sliding mechanism connected to the arm mechanism and configured to move substantially perpendicular to the horizontal plane, and a grabbing mechanism configured to be removably attached to the sliding mechanism and configured to grab the component of the device.

17 Claims, 14 Drawing Sheets

U.S. PATENT DOCUMENTS

| | | | | |
|---|---|---|---|---|
| 7,040,411 | B2 | 5/2006 | Kainer et al. | |
| 7,051,989 | B2 | 5/2006 | Springett et al. | |
| 7,121,348 | B2 * | 10/2006 | Hemphill et al. | 166/373 |
| 7,389,820 | B2 | 6/2008 | Day | |
| 2002/0028030 | A1 * | 3/2002 | Michioka et al. | 384/45 |
| 2002/0035897 | A1 * | 3/2002 | Buytaert et al. | 81/57.35 |
| 2004/0238177 | A1 | 12/2004 | Fossli | |
| 2005/0051545 | A1 * | 3/2005 | Estes | 220/1.5 |
| 2005/0092497 | A1 | 5/2005 | Rashid et al. | |
| 2006/0180564 | A1 | 8/2006 | Keppel | |
| 2008/0149355 | A1 | 6/2008 | Joven Marco | |

FOREIGN PATENT DOCUMENTS

| | | | |
|---|---|---|---|
| WO | 2004094774 | A1 | 11/2004 |
| WO | 2005042914 | A1 | 5/2005 |
| WO | 2005059297 | A2 | 6/2005 |
| WO | 2008048163 | A1 | 4/2008 |

OTHER PUBLICATIONS

Website: "Specialty Jib Cranes," Systems Design Incorporated, Downloaded Jun. 4, 2010, http://www.jibcranes.com, pp. 1-3.

Website: "Jib Cranes—Articulating Arm," Systems Design Incorporated, Downloaded Jun. 4, 2010, http://www.jibcranes.com/page2.htm, pp. 1-2.

Website: "Jib Cranes—Enclosed Track," Systems Design Incorporated, Downloaded Jun. 4, 2010, http://www.jibcranes.com/page3.htm, pp. 1-2.

Website: "Jib Cranes—Portable," Systems Design Incorporated, Downloaded Jun. 4, 2010, http://www.jibcranes.com/page4.htm, pp. 1-2.

* cited by examiner

CRANE DEVICE AND METHOD

BACKGROUND

1. Technical Field

Embodiments of the subject matter disclosed herein generally relate to methods and systems and, more particularly, to mechanisms and techniques for handling heavy components of a device.

2. Discussion of the Background

During the past years, with the increase in price of fossil fuels, the interest in developing new production fields has dramatically increased. However, the availability of land-based production fields is limited. Thus, the industry has now extended drilling to offshore locations, which appear to hold a vast amount of fossil fuel.

The existing technologies for extracting the fossil fuel from offshore fields use a system 10 as shown in FIG. 1. More specifically, the system 10 includes a vessel 12 having a reel 14 that supplies power/communication cords 16 to a controller 18. The controller 18 is disposed undersea, close to or on the seabed 20. In this respect, it is noted that the elements shown in FIG. 1 are not drawn to scale and no dimensions should be inferred from FIG. 1.

FIG. 1 also shows a wellhead 22 of the subsea well and a drill line 24 that enters the subsea well. At the end of the drill line 24 there is a drill (not shown). Various mechanisms, also not shown, are employed to rotate the drill line 24, and implicitly the drill, to extend the subsea well.

However, during normal drilling operation, unexpected events may occur that could damage the well and/or the equipment used for drilling. One such event is the uncontrolled flow of gas, oil or other well fluids from an underground formation into the well. Such event is sometimes referred to as a "kick" or a "blowout" and may occur when formation pressure inside the well exceeds the pressure applied to it by the column of drilling fluid. This event is unforeseeable and if no measures are taken to prevent it, the well and/or the associated equipment may be damaged. Although the above discussion was directed to subsea oil exploration, the same is true for ground oil exploration.

Thus, a blowout preventer (BOP) might be installed on top of the well to seal the well in case that one of the above events is threatening the integrity of the well. The BOP is conventionally implemented as a valve to prevent the release of pressure either in the annular space between the casing and the drill pipe or in the open hole (i.e., hole with no drill pipe) during drilling or completion operations. Recently, a plurality of BOPs may be installed on top of the well for various reasons. FIG. 1 shows two BOPs 26 or 28 that are controlled by the controller 18.

Such plural BOPs assembled together form a BOP stack. A traditional BOP stack may be tens of meters high and weighs tens of thousands of kilograms. Various components of the BOP stack need to be replaced from time to time. An example of the BOP 26 is shown in FIG. 2. The BOP 26 shown in FIG. 2 has, among other things, two ram blocks 30 that are supported by respective piston rods 32. The two ram blocks 30 are configured to move along a direction parallel to a longitudinal axis of the piston rods 32. The ram blocks 30 may severe the drill line 24 or other tools that cross a vertical wellbore 34 of the BOP 26. However, after cutting the drill line 24 for a number of times, the ram blocks 30 and/or their respective cutting edges need to be verified and sometimes reworked. For this reason, the BOP 26 of FIG. 2 is provided with a bonnet 36, for each ram block 30, that can be opened for providing access to the ram blocks. FIG. 2 shows the bonnet 36 having a hinge 38 that rotatably opens the bonnet 36.

FIG. 3 shows the BOP 26 having the bonnet 36 opened so as to expose the ram block 30. As the weight of the ram block may be in excess of 100 kg, sometimes around 400 kg, it would be difficult for one or more persons to remove the ram block 30 from the BOP 26 for maintenance. Thus, a crane may be used to lift and store the ram block 30 in a desired position while undergoing maintenance.

However, the usage of the crane becomes impractical when plural BOPs are assembled to form the BOP stack. The BOP stack has a frame of its own that contains the multiple BOPs. However, the frame of the BOP stack also limits the accessibility of a crane to the BOPs. Further, as the BOPs are disposed on top of each other and one BOP may be as high as a few meters from the floor, it is impractical for maintenance personnel to directly access the BOP components (they are too high to be reachable) even when the BOP stack is in a maintenance facility. In addition, if the ram block has to be replaced while the BOP stack is in the field (e.g., deep under sea or when the BOP stack is brought on the maintenance vessel), it is difficult to use a crane attached to a solid base to remove various components of the BOPs with that crane in order to reach the ram blocks.

Accordingly, it would be desirable to provide systems and methods that avoid the afore-described problems and drawbacks.

SUMMARY

According to one exemplary embodiment, there is a crane for moving a component of a device. The crane includes a supporting mechanism configured to be fixedly attached to the device, an arm mechanism connected to the supporting mechanism and configured to move in a horizontal plane, a sliding mechanism connected to the arm mechanism and configured to move substantially perpendicular to the horizontal plane, and a grabbing mechanism configured to be removably attached to the sliding mechanism and configured to grab the component of the device.

According to another exemplary embodiment, there is a blowout preventer (BOP) crane system for moving a component of the BOP. The BOP crane system includes a body of the BOP having a horizontal chamber; at least a ram block provided in the horizontal chamber and configured to move in the horizontal chamber; a bonnet configured to close the at least a ram block in the horizontal chamber; a supporting mechanism configured to be fixedly attached to the body of the BOP; an arm mechanism connected to the supporting mechanism and configured to move in a horizontal plane; a sliding mechanism connected to the arm mechanism and configured to move substantially perpendicular to the horizontal plane; and a grabbing mechanism configured to be removably attached to the sliding mechanism and configured to grab the component of the device.

According to still another exemplary embodiment, there is a method for handling a ram block of a blowout preventer (BOP). The method includes grabbing a bonnet of the BOP with a first tool attached to a crane, wherein the crane includes a supporting mechanism configured to be fixedly attached to a body of the BOP; moving an arm mechanism of the crane, which is connected to the supporting mechanism, in a horizontal plane to move the bonnet to uncover the ram block; storing the bonnet; replacing the first tool with a second tool, wherein the first and second tools are received by a sliding mechanism connected to the arm mechanism; connecting the second tool to the ram block; and lifting the ram block by actuating the sliding mechanism, which is connected to the arm mechanism, the sliding mechanism being configured to move substantially perpendicular to the horizontal plane.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the exemplary embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to the terminology and structure of a BOP stack. However, the embodiments to be discussed next are not limited to these systems, but may be applied to other systems that require handling heavy components at certain heights above the floor.

Reference throughout the specification to "an exemplary embodiment" or "another exemplary embodiment" means that a particular feature, structure, or characteristic described in connection with an embodiment is included in at least one embodiment of the subject matter disclosed. Thus, the appearance of the phrases "in an exemplary embodiment" or "in another exemplary embodiment" in various places throughout the specification is not necessarily referring to the same embodiment. Further, the particular features, structures or characteristics may be combined in any suitable manner in one or more embodiments.

According to an exemplary embodiment, a crane may be attached to a BOP and can be configured to be able to reach the desired components of the BOP even when the BOP is assembled with other components in a BOP stack. This crane may be fixed to the body of the BOP and may be sized so as to allow it to reach the BOP stack and fetch, for example, the ram blocks of the BOP. The crane may be a jib crane in one exemplary embodiment to be discussed next. The crane may be manually, electrically, and/or hydraulically controlled by an operator. Various exemplary embodiments are discussed next for illustrating the features of such a crane.

Figure 1:
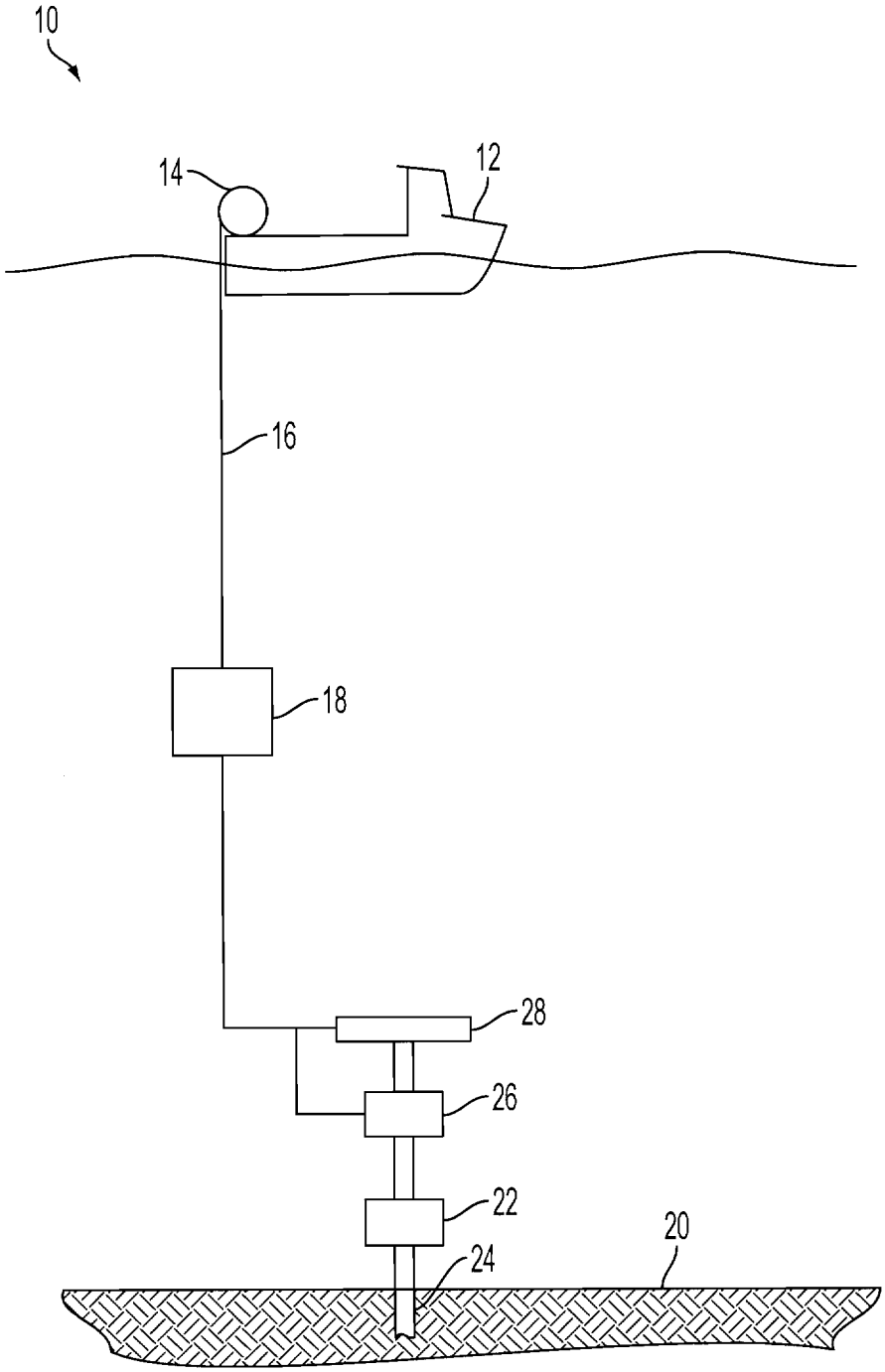
FIG. 1 BACKGROUND ART
FIG. 1 is a schematic diagram of a conventional offshore rig.
Figure 2:
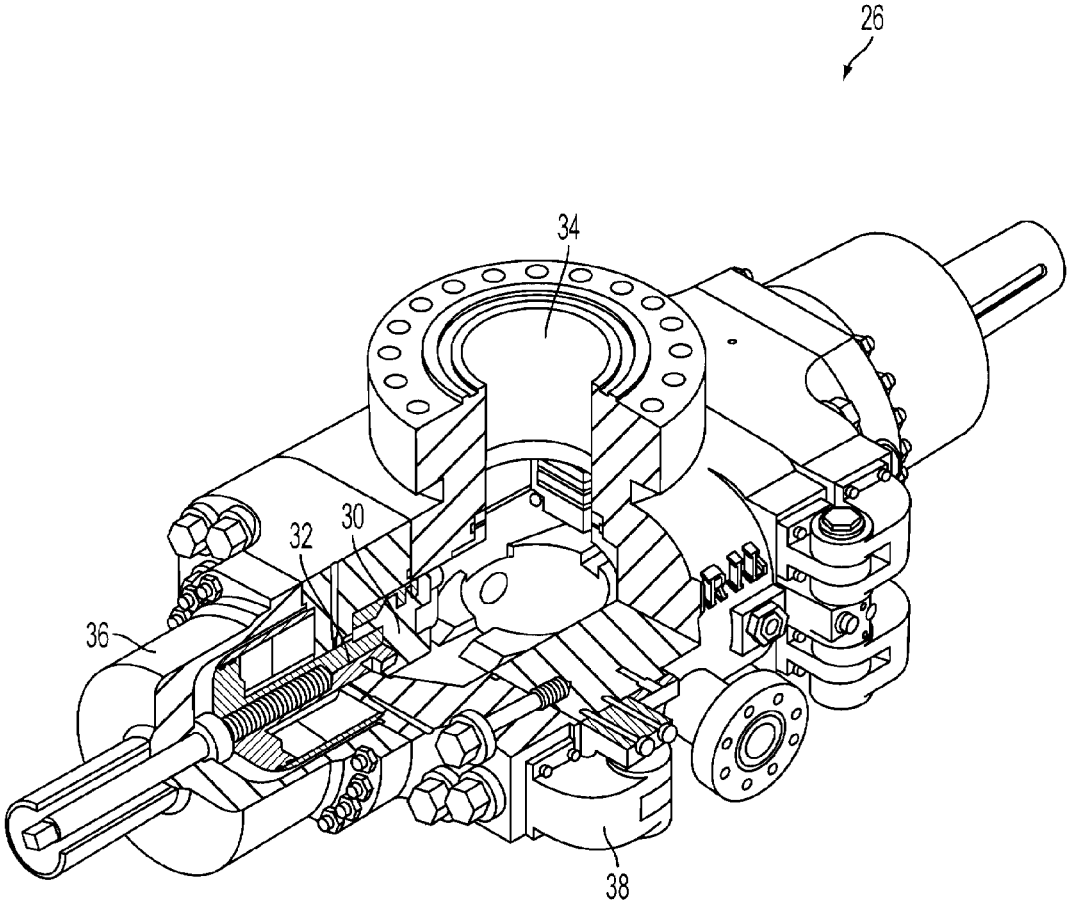
FIG. 2 BACKGROUND ART
FIG. 2 is a schematic diagram of a BOP.
Figure 3:
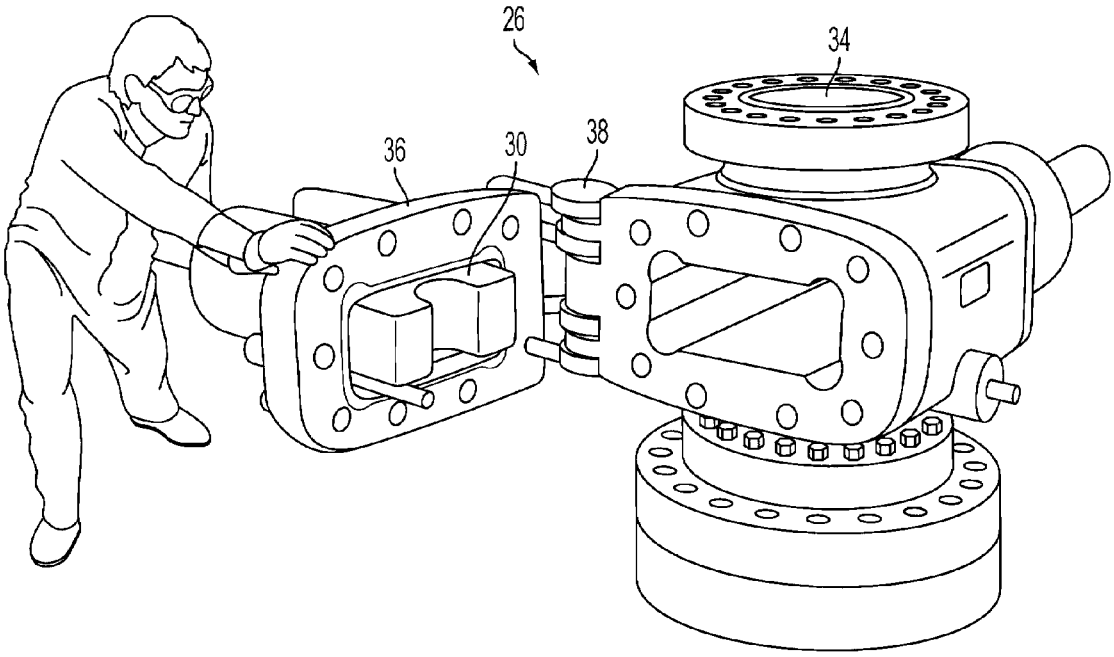
FIG. 3 BACKGROUND ART
FIG. 3 is a schematic diagram of an opened BOP.
Figure 4:
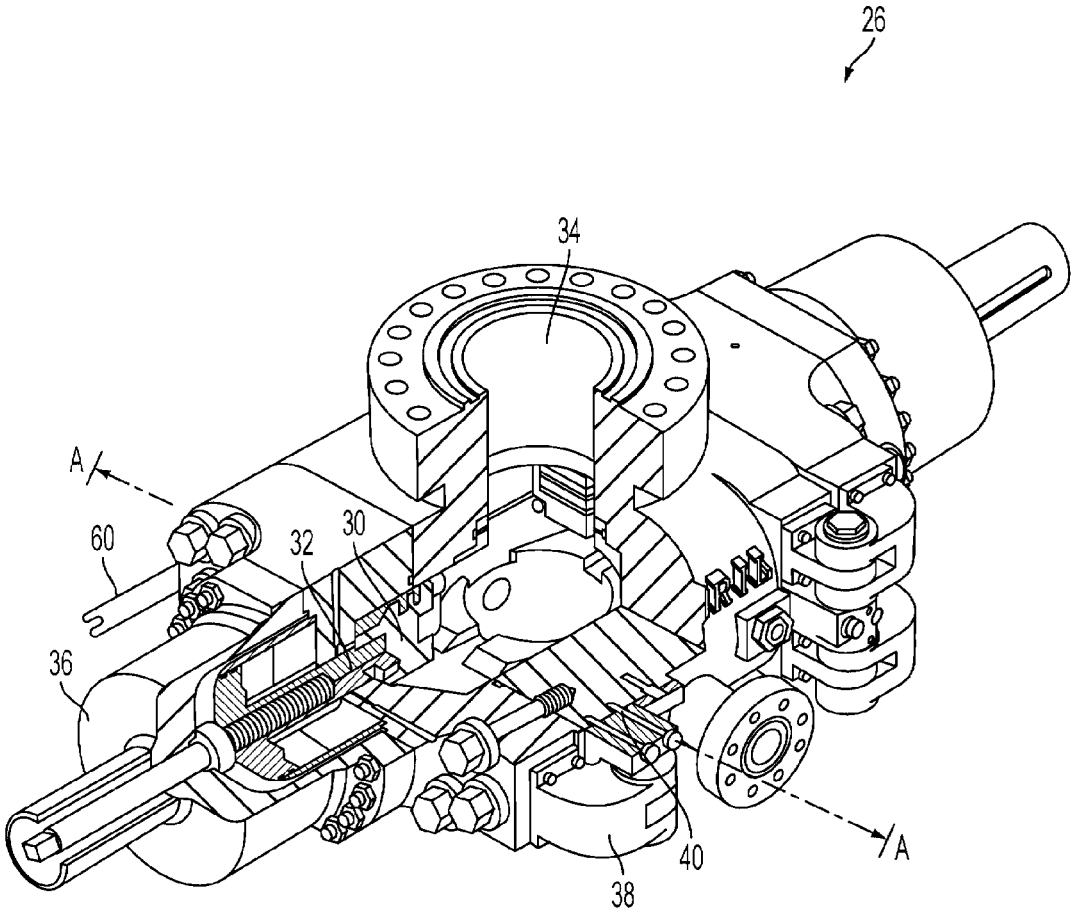
FIG. 4 is a schematic diagram of a BOP provided with a crane according to an exemplary embodiment.
Figure 5:
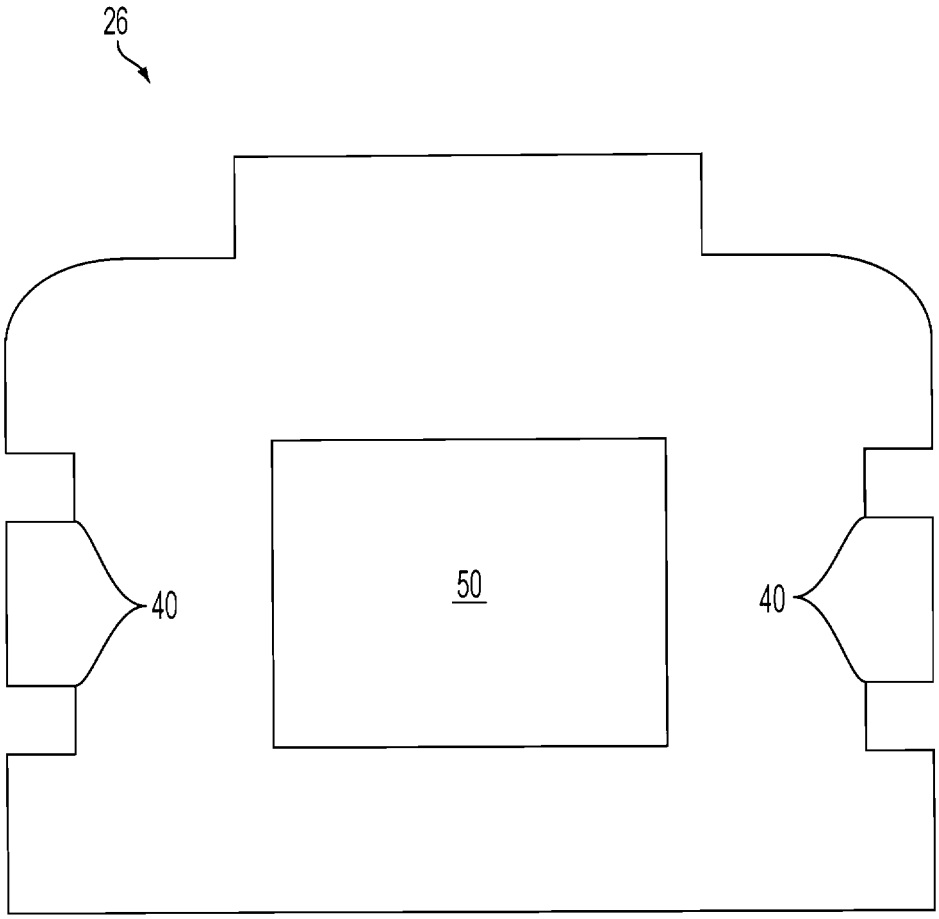
FIG. 5 is a cross section of a body of the BOP of FIG. 4 along line A-A.

According to an exemplary embodiment illustrated in FIG. 4, a BOP is formed to have the hinge 38 disposable on either side of the bonnet 36. FIG. 4 shows the hinge 38 disposed on the visible side of the BOP 26 and a crane 60 disposed on the hidden side of the BOP 26. However, according to this exemplary embodiment, plural holes 40 are formed on the BOP 26 on each side of the bonnet 36 for receiving the hinge 38. Once a user instructs the manufacturer where to place the hinge 38, the plural holes 40 on the unused side of the bonnet 36 are available for other use. According to an exemplary embodiment, the holes 40 are formed in the body of the BOP 26, as shown in FIG. 4. The plural holes 40 formed in the BOP on the non visible side of the bonnet 36 are shown in FIG. 5, which is a cross section along line A-A in FIG. 4. Cavity 50 is configured to accommodate the ram block 30. In one exemplary embodiment, four holes 40 (only two holes 40 are shown in FIG. 4) are formed in the BOP 26 on each side of the bonnet 36. However, more or less holes may be formed depending on the hinge 38 that is attached to the BOP 26.

The spare holes 40 (i.e., the holes 40 that are not used to attach the hinge 38) formed in the body of the BOP 26 may provide the desired support for the crane. Once the crane is fixed to the BOP 26, the crane may be left assembled to the BOP even undersea, such that access to some of the components of the BOP is facilitated. The crane may be operable in the maintenance facility, on a vessel while the BOP stack is transported and also undersea. In one exemplary embodiment, each BOP of the BOP stack may have its own crane attached to its body. In another exemplary embodiment, the crane is a jib crane having a vertically moving component. A jib crane is defined in the context of this specification as a lifting device having at least one boom (jib) configured to move relative to a fixed base of the crane.

Figure 6:
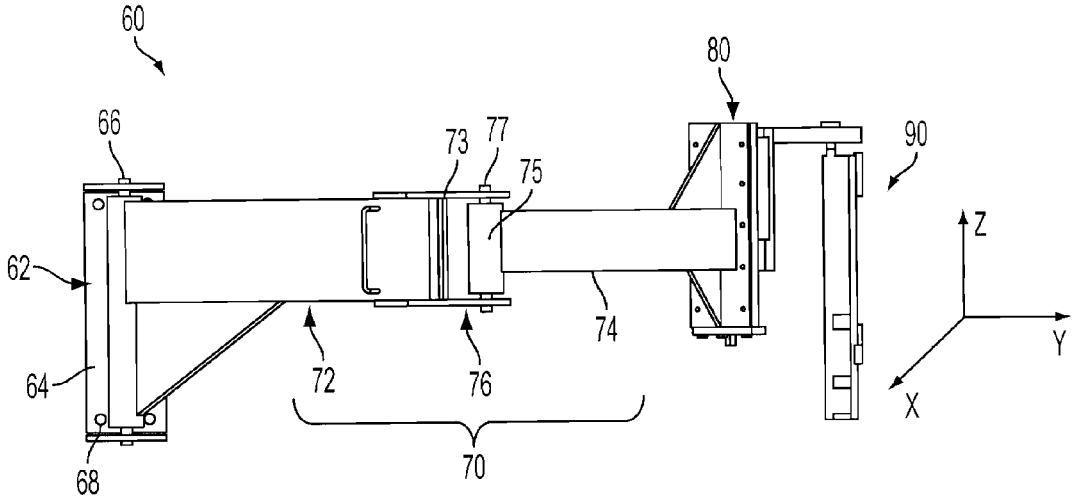
FIGS. 6-9 are schematic diagrams of a crane shown from various angles according to an exemplary embodiment.

In an exemplary embodiment shown in FIG. 6, a crane 60 has a supporting mechanism 62, an arm mechanism 70, a sliding mechanism 80, and a grabbing mechanism 90. Each mechanism is discussed next in details.

The supporting mechanism 62 may be a simply plate 64 that connects to the arm mechanism 70 with a pin 66. The plate 64 may have four holes 68 that correspond to holes 40 on the BOP 26. These holes 68 permit the entire crane 60 to be attached to the holes 40 of the BOP 26 with appropriate bolts, screws or other means known by those skilled in the art.

Figure 7:
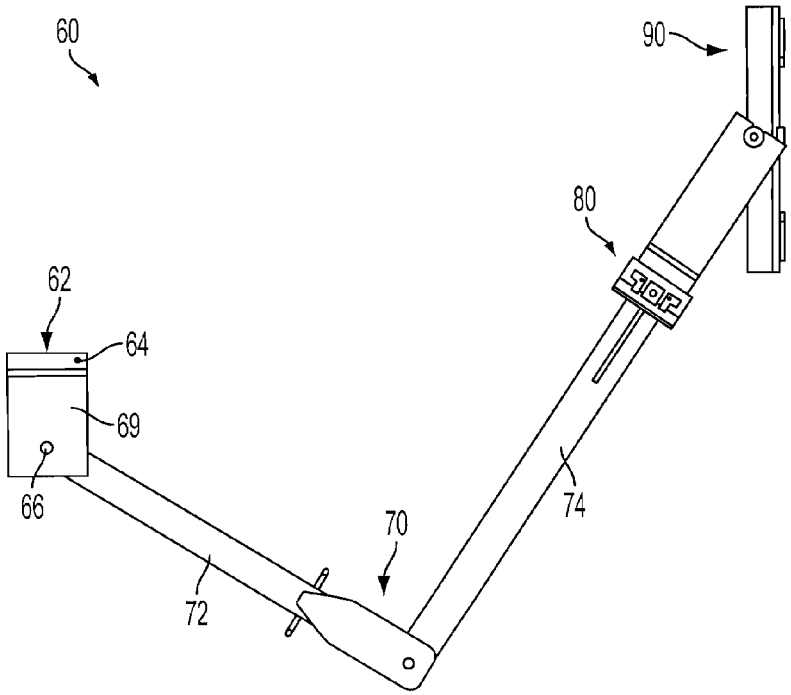

FIG. 7 is a top view of crane 60 that illustrates a top plate 69 being attached to a first end of plate 64. According to an exemplary embodiment, a bottom plate 69 is fixed to a second end of the plate 64 to form a "U" bracket for receiving the arm mechanism 70. The pin 66 enters trough corresponding holes formed in the top and bottom plates 69. One skilled in the art would appreciate that other mechanisms may be used for providing the support necessary for the crane 60.

With regard to FIGS. 6 and 7, the arm mechanism 70 includes first and second arms 72 and 74 connected to each other by an interface 76. Interface 76 may include, in one exemplary embodiment, a "U" bracket 73 attached to the first arm 72 and a tubular part 75 attached to the second arm 74. The U bracket 73 is attached via a bolt 77 to the tubular part 75. Other mechanisms for attaching the first and second arms 72 and 74 are possible as would be appreciated by those skilled in the art.

In an exemplary embodiment, the arm mechanism 70 has between two and five arm components. FIGS. 6 and 7 shows two arm components. However, the exemplary embodiments are not limited to two arm components. Further, FIGS. 6 and 7 show that the first and second arms 72 and 74 are connected to each other via a first joint such that an angle between these two arms in a X-Z or Y-Z plane is substantially fixed and only an angle between the two arms in a X-Y plane (horizontal plane) may be changed by the operator. The angle may be changed between 0 and 360 degrees. These characteristics define a jib crane. Also, the arms 72 and 74 may be connected to a displacing mechanism (not shown), which is configured to move one arm relative to another when instructed as such by the operator or a computer. However, the crane to be attached to the BOP may be a crane that is different that the jib crane.

Figure 8:
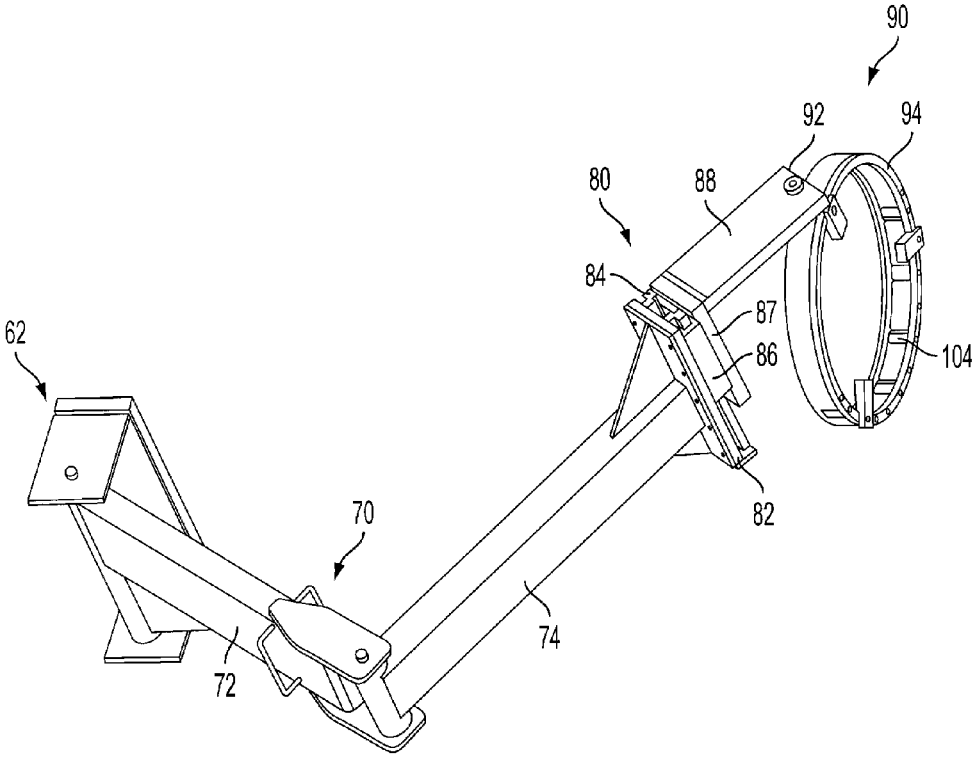
Figure 9:
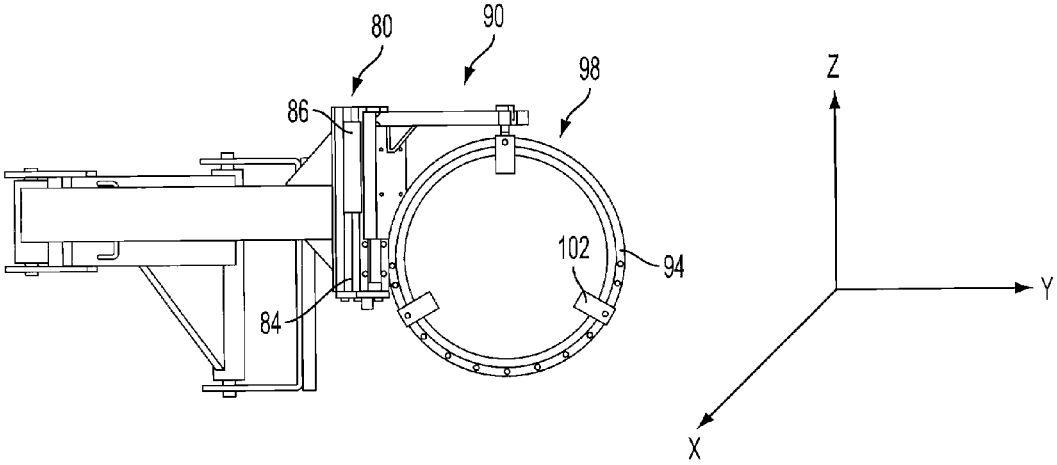

The sliding mechanism 80 is better illustrated in FIGS. 8 and 9. FIG. 8 shows the sliding mechanism 80 having a base plate 82 that is attached to the second arm 74. The base plate 82 may have two rails 84 or more formed along the base plate 82. The two rails 84 are substantially perpendicular to the X-Y horizontal plane, i.e., within normal tolerances. In an exemplary embodiment, the base plate 82 may form a specified angle (for example, between 1 and 10 degrees) with the second arm 74. A sliding plate 86 is configured to slide along the rails 84 in a vertical motion. The sliding plate 86 may be configured to be manually, electrically and/or hydraulically actuated along a Z direction as shown in FIG. 9. The sliding mechanism 80 advantageously allows the arm mechanism 70 of crane 60 to be misaligned with the ram block or other components of the BOP while adjusting the grabbing mechanism 90 to connect to the ram block or the other components of the BOP.

Figure 10:
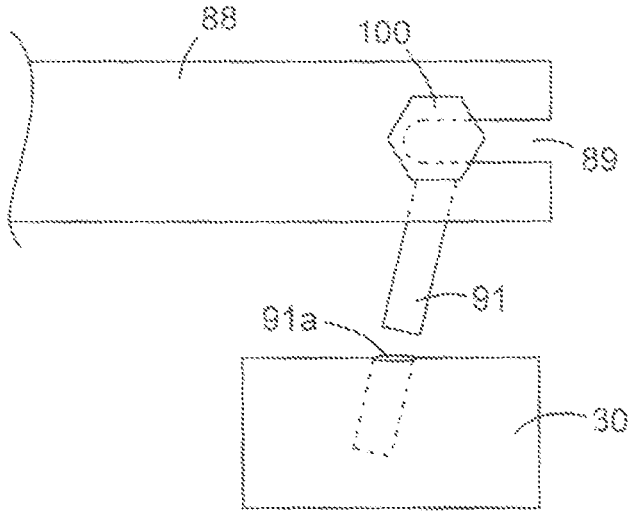
FIG. 10 shows a detailed of a grabbing mechanism according to an exemplary embodiment.
Figure 11:
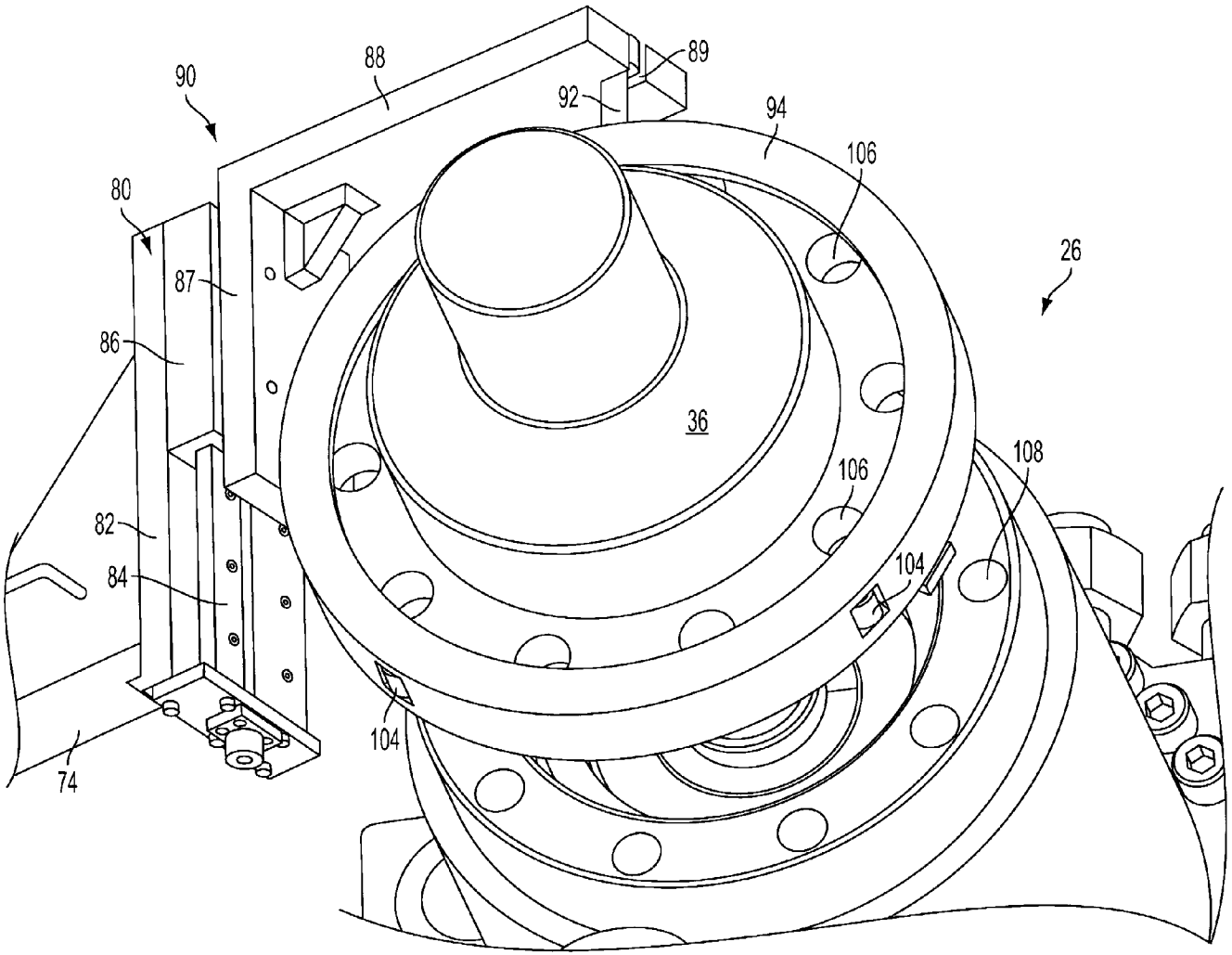
FIG. 11 shows a BOP with a screwed bonnet and a crane according to an exemplary embodiment.

The sliding mechanism 80 may further include a plate 87 that is attached to the sliding plate 86. The plate 87 may be connected to a supporting plate 88. The supporting plate 88 is configured to support, for example, the grabbing mechanism 90. The grabbing mechanism 90 may include a connecting part 92 (which may be a screw) and a tool 94. In one exemplary embodiment, the supporting plate 88 may have a slot 89 as shown in FIGS. 10 and 11. The slot 89 is configured to receive, for example, the connecting part 92 of the grabbing mechanism 90. According to an exemplary embodiment, the connecting part 92 is a screw 91 having a head 100, that is larger than a width of the slot 89. Thus, the grabbing mechanism 90 may be easily placed/removed on and from slot 89. If the ram block 30 is manufactured to have a mating surface 91*a* for the screw 91, then the connecting part 92 of the grabbing mechanism 90 may be attached (e.g., screwed) to the ram block 30 and moved by crane 60 together with the ram block 30. The grabbing mechanism 90 may be, according to other exemplary embodiments, a magnetic device, a hook connected via a cable and pulley to a motor, a hook, etc.

Figure 14:
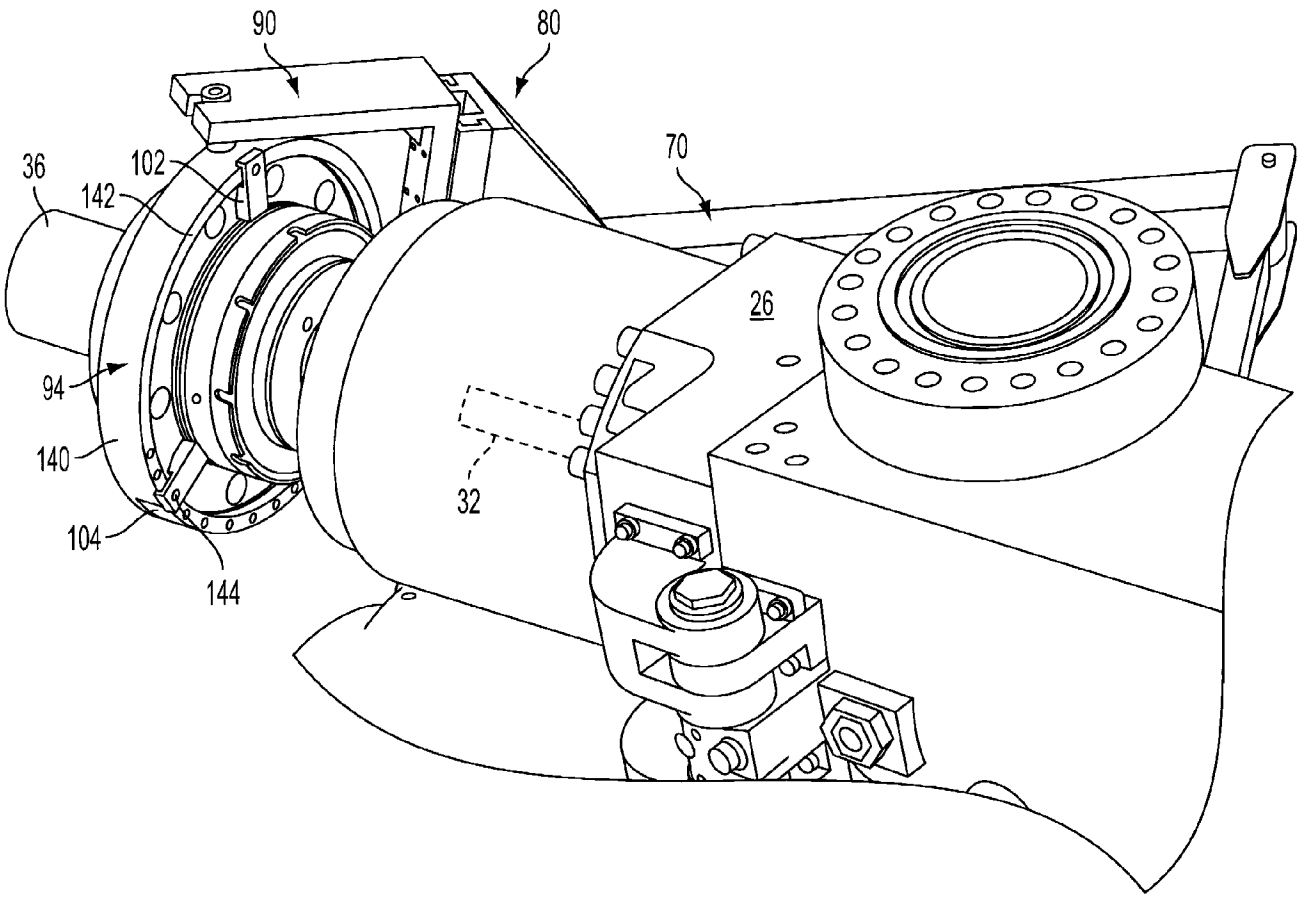
FIG. 14 shows a crane attached to a BOP according to an exemplary embodiment.

In the exemplary embodiments shown in FIGS. 6-9, the grabbing mechanism 90 may include the connecting part 92 and the tool 94. The tool 94 is configured to handle the bonnet 36 of the BOP 26. The tool 94 may be circular to match the shape of the bonnet 36 shown in FIG. 4. However, for a different bonet, the tool 94 may be shaped accordingly. The tool 94 may include fixing parts 102 as shown in FIGS. 9 and 14. According to an exemplary embodiment, three such fixing parts 102 may be provided for grabbing the bonnet 36.

According to another exemplary embodiment, the bonnet 36 shown in FIG. 4 is not hinged to the body of the BOP 26 but screwed as shown in FIG. 11. For this situation, because the bonnet itself may weight in excess of 200 kg, and up to 400 kg, it would be almost impossible for a traditional crane to grab the bonnet and unscrew it from the body of the BOP. However, the tool 94 shown in FIGS. 8 and 9 may grab the bonnet 36 as shown in FIG. 11 with fixing parts 102 and may hold the bonnet while screws (not shown) are removed from holes 106 of the bonnet 36 and corresponding holes 108 of the BOP body. Alternatively, if the bonnet 36 itself is screwed into the body of the BOP 26 (not shown), the tool 94 may rotate the entire bonnet 36 relative to the body of the BOP 26. Such rotation may be achieved by a system of ball bearings 104 discretely distributed inside the tool 94, as shown in FIGS. 8 and 11. This situation is discussed later in more details. The rotations may be performed manually by the operator or automatically by the crane 60. As already discussed above, the entire tool 94 may be easily removed from slot 89 of supporting plate 88 or from connecting part 92 and be replaced with another tool.

The sliding mechanism 80 is configured to lift the ram block 30 from the supporting rod 32 such that once the bonnet 36 is open or unscrewed, the ram block 30 may be fully removed from the BOP 26. Although the entire discussion of the crane 60 has been centered on the BOP 26, the same is true for the BOP 28 or other BOPs that might be present in the BOP stack. Also, this discussion is valid not only for BOPs that are removed vertically from their supporting rods but also for those BOPs that are removed horizontally from their supporting rods.

Variations of the crane 60 discussed in the above exemplary embodiments may include, for example, making the crane 60 able to move in a plane other than the X-Y plane, using more arms for the arm mechanism, using other sliding devices instead or in combination with the illustrated sliding mechanism, and/or using differently shaped tools for achieving the movement of the ram block 30 and/or the bonnet 36.

Figure 12:
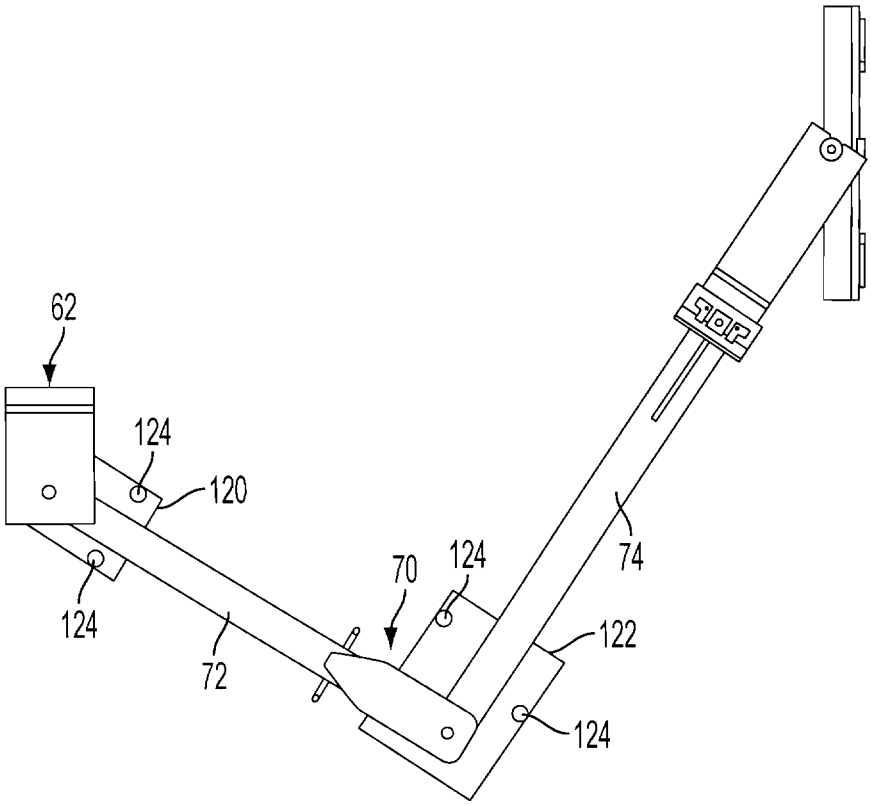
FIG. 12 shows a crane with a limiting device that limits a motion of the crane according to an exemplary embodiment.

Another variation of the exemplary embodiments is shown in FIG. 12. In this figure, the first and second arms 72 and 74 of the arm mechanism 70 have a limited degree of rotation in order to enhance accident prevention. More specifically, as a safety feature, the motion of the arm mechanism 70 is limited such that an operator performing maintenance on the BOP 26 has certain safety areas around the BOP where the crane 60 cannot reach. This feature may be appreciated if the operator performs the maintenance of the BOP 26 on a vessel, which constantly moves due to the high seas. Due to the large waves, the crane 60 can swivel uncontrolled around the supporting mechanism 62, potentially injuring the personnel that works in close proximity. Thus, as shown in FIG. 12, limiting plates 120 and/or 122 may be provided either on the arm mechanism 70 and/or the supporting mechanism 62. These plates may be equipped with limiting rods 124 that extend substantially along the Z axis, i.e., substantially perpendicular to the first and second arms 72 and 74. In this way, the rotational motion of first and second arms 72 and 74 may be restricted to a desired angle. Those skilled in the art would recognize that other mechanism for restricting the rotational motion of the arm mechanism 70 may be implemented.

Figure 13:
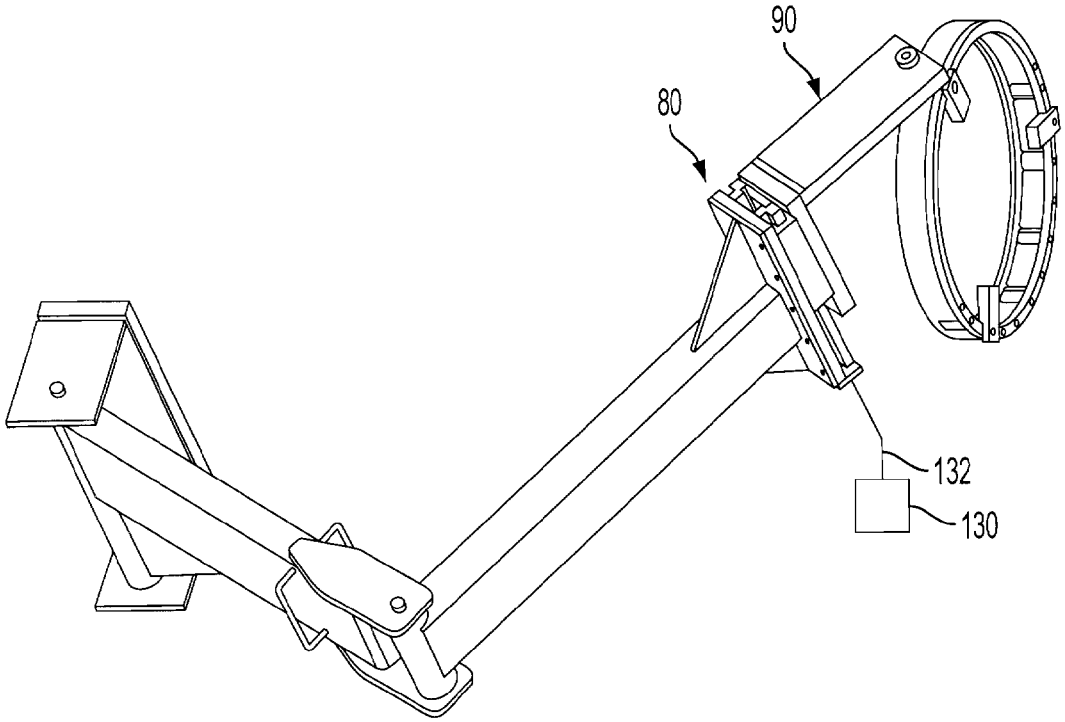
FIG. 13 shows a crane having a power device according to an exemplary embodiment.

In another exemplary embodiment, the sliding mechanism 80 is provided with a power source 130 that provides power via a conduit 132 to the sliding mechanism 80 as shown in FIG. 13. The power source 130 may be an electric source, a hydraulic source, or simply a wrench that is manually rotated by an operator. The conduit 132 may be an electric wire, a hose, a pipe, etc.

In another exemplary embodiment, the crane 60 is attached to the BOP 26 such that the arm mechanism 70 extends substantially parallel to the piston rod 32, as shown in FIG. 14. The term substantially is used in this context to imply that crane 60 may make an angle between +15 to −15 degrees with the piston rod, either due to the weight of the ram block 30 when attached to the crane 60, or due to the misplacement of holes 40 on the body of the BOP 26. Further, the crane 60 does not have to be aligned (on the Z axis) with the ram block 30 as the sliding mechanism 80 compensates for this misalignment.

Figure 15:
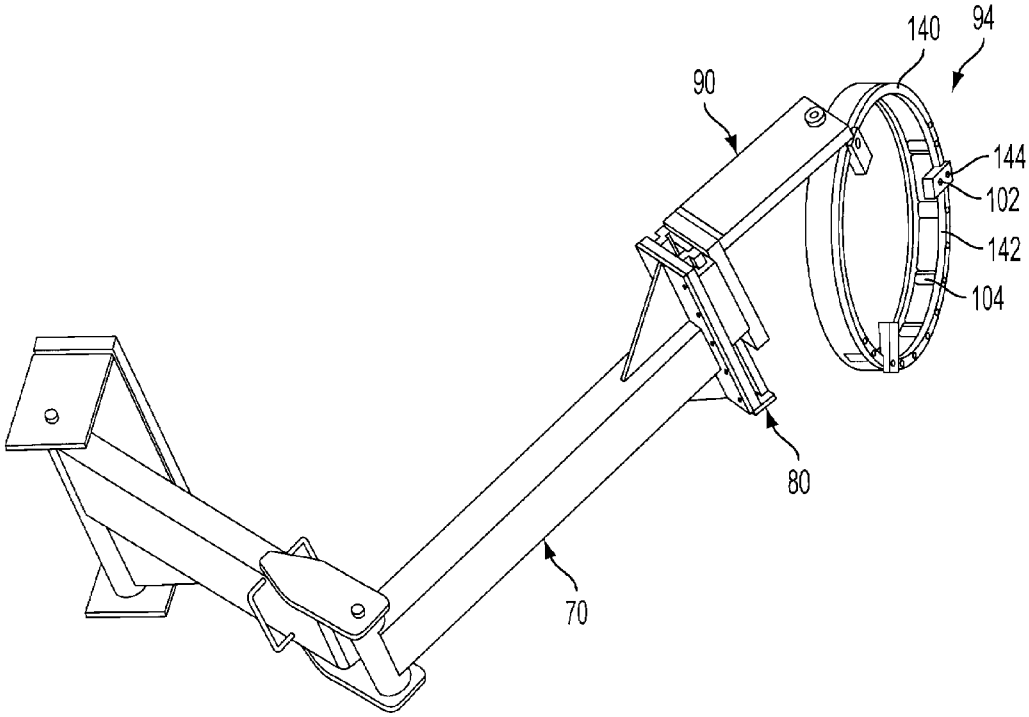
FIG. 15 shows a tool that is attached to a crane according to an exemplary embodiment.

According to another exemplary embodiment, the tool 94 may have, as shown in FIGS. 14 and 15, an external circular frame 140 and an internal circular frame 142. Plural bearings 104 may be provided in the external circular frame 140 and configured to rotationally hold the bonnet 36 of the BOP 26 and/or other components of the BOP 26. The plural bearings 104 may be sandwiched between the external circular frame 140 and the internal circular frame 142. Alternatively, the plural bearings 104 may be fixed on corresponding axes that are connected to the external circular frame 140. Fixing parts 102 may be attached to the external or internal circular frame and configured to slide/rotate relative the circular frames to fix the bonnet 36 of the BOP 26. FIGS. 14 and 15 show the fixing parts 102 attached to the external circular frame 140 by corresponding screws 144.

Figure 16:
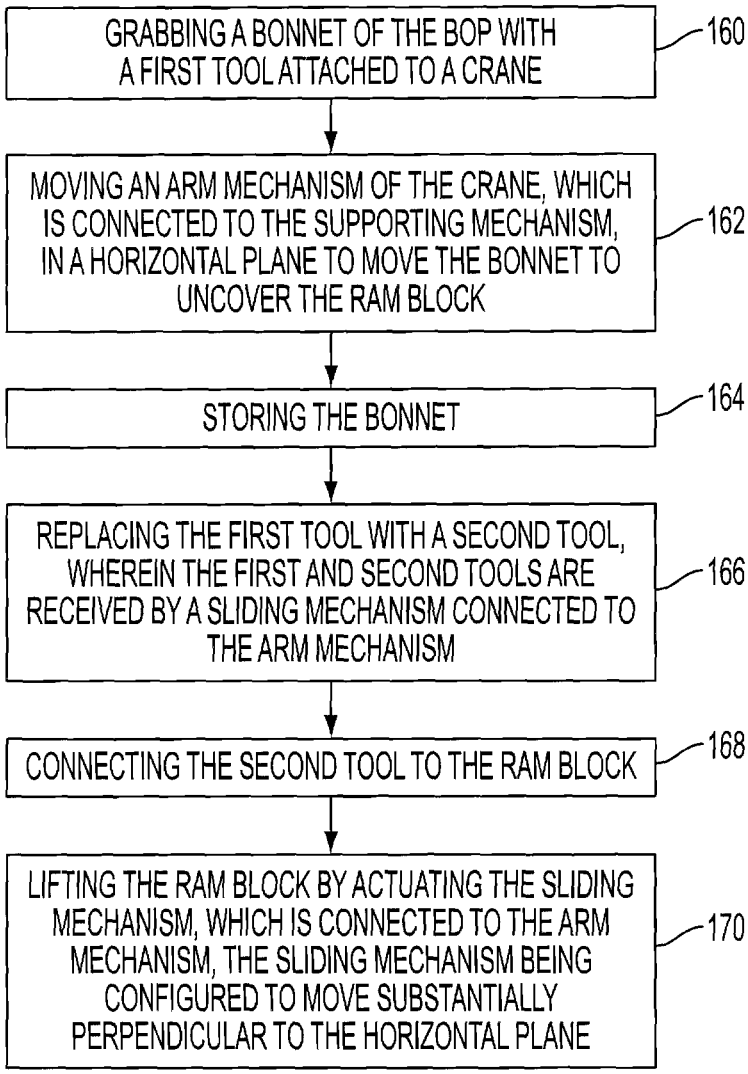
FIG. 16 is a flow chart illustrating steps of a method for moving a component of the BOP with a crane according to an exemplary embodiment.

According to an exemplary embodiment, a method for operating the crane when connected to a BOP is discussed with regard to FIG. 16. The method includes a step 160 of grabbing a bonnet of the BOP with a first tool attached to a crane, wherein the crane includes a supporting mechanism configured to be attached to a body of the BOP. The method includes a step 162 of moving an arm mechanism of the crane, which is connected to the supporting mechanism, in a horizontal plane to move the bonnet to uncover the ram block, a step 164 of storing the bonnet, a step 166 of replacing the first tool with a second tool, wherein the first and second tools are received by a sliding mechanism connected to the arm mechanism, a step 168 of connecting the second tool to the ram block, and a step 170 of lifting the ram block by actuating the sliding mechanism, which is connected to the arm mechanism, the sliding mechanism being configured to move substantially perpendicular to the horizontal plane.

The disclosed exemplary embodiments provide a crane system and a method for moving heavy components of a BOP or other heavy devices. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples to disclose the exemplary embodiments, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. A crane for moving a component of a blowout preventer, the crane comprising:

a supporting mechanism configured to be fixedly attached to the blowout preventer;

an arm mechanism connected to the supporting mechanism and configured to move in a horizontal plane, the arm mechanism including a first arm configured to rotate in the horizontal plane;

a sliding mechanism connected to the arm mechanism and configured to move substantially perpendicular to the horizontal plane;

a grabbing mechanism configured to be removably attached to the sliding mechanism and configured to grab the component of the blowout preventer, wherein the sliding mechanism includes a plate having a slot and the grabbing mechanism includes a bolt like element configured to slide into the slot and a head of the bolt like element is larger than a width of the slot, and wherein the bolt like element is directly screwed into a ram block of the blowout preventer.

2. The crane of claim 1, wherein the arm mechanism further comprises:

a second arm connected through a first joint to the first arm such that the second arm is configured to move relative to the first arm and the first arm is connected through a second joint to the supporting mechanism.

3. The crane of claim 1, wherein the sliding mechanism comprises:

plural rails that extend substantially perpendicular to the horizontal plane.

4. The crane of claim 1, further comprising:

a power source connected to the sliding mechanism for actuating the sliding mechanism substantially perpendicular to the horizontal plane.

5. The crane of claim 1, wherein the arm mechanism extends substantially parallel to a piston rod of the blowout preventer.

6. The crane of claim 1, wherein the grabbing mechanism comprises a tool connected to the bolt, the tool including, an external circular frame, plural bearings provided in the external circular frame and configured to rotationally hold a bonnet of the device;

an internal circular frame configured such that the plural bearings are sandwiched between the external circular frame and the internal circular frame, and fixing parts attached to the external circular frame and configured to slide relative the external circular frame to fix the bonnet of the device.

7. A blowout preventer (BOP) crane system for moving a component of the BOP, the BOP crane system comprising:

a body of the BOP having a horizontal chamber;

at least a ram block provided in the horizontal chamber and configured to move in the horizontal chamber;

a bonnet configured to close the at least a ram block in the horizontal chamber, a supporting mechanism configured to be fixedly attached to the body of the BOP;

an arm mechanism connected to the supporting mechanism and configured to move in a horizontal plane;

a sliding mechanism connected to the arm mechanism and configured to move substantially perpendicular to the horizontal plane; and a grabbing mechanism configured to be removably attached to the sliding mechanism and configured to grab the component of the device, wherein the sliding mechanism includes a plate having a slot and the grabbing mechanism comprises a bolt having a head larger than the slot and a tool connected to the bolt, and wherein the tool includes:

an external circular frame, plural bearings provided in the external circular frame and configured to rotationally hold the bonnet of the BOP, an internal circular frame configured such that the plural bearings are sandwiched between the external circular frame and the internal circular frame, and fixing parts attached to the external circular frame and configured to slide relative the external circular frame to fix the bonnet of the BOP.

8. The BOP crane system of claim 7, wherein the arm mechanism comprises:

first and second arms connected through a first joint such that the second arm is configured to move relative to the first arm and the first arm is connected through a second joint to the supporting mechanism and is configured to move relative to the supporting mechanism.

9. The BOP crane system of claim 7, wherein the arm mechanism extends substantially parallel to a piston rod of the at least a ram block.

10. The BOP crane system of claim 7, wherein the bolt is configured to screw into the at least a ram block of the BOP.

11. The BOP crane system of claim 7, further comprising: other BOPs forming a BOP stack with the BOP.

12. The BOP crane system of claim 11, further comprising: plural cranes, each fixed to a corresponding BOP of the BOP stack.

13. A method for handling a ram block of a blowout preventer (BOP), the method comprising:

grabbing a bonnet of the BOP with a first tool attached to a crane, wherein the crane includes a supporting mechanism configured to be fixedly attached to a body of the BOP;

moving an arm mechanism of the crane, which is connected to the supporting mechanism, in a horizontal plane to move the bonnet to uncover the ram block;

storing the bonnet;

replacing the first tool with a second tool, wherein the first and second tools are received by a sliding mechanism connected to the arm mechanism;

connecting the second tool to the ram block; and lifting the ram block by actuating the sliding mechanism, which is connected to the arm mechanism, the sliding mechanism being configured to move substantially perpendicular to the horizontal plane.

14. The method of claim 13, further comprising:

rotating a part of the first tool to rotate the bonnet such that the bonnet is unscrewed from the body of the BOP.

15. A blowout preventer (BOP) having a crane for moving a component of BOP, the BOP comprising:

a ram body having a horizontal chamber containing a movable ram block; the crane comprising:

a supporting mechanism fixedly attached to the ram housing;

an arm mechanism connected to the supporting mechanism and configured to move in a horizontal plane, the arm mechanism including a first arm configured to rotate in the horizontal plane;

a sliding mechanism connected to the arm mechanism and configured to move substantially perpendicular to the horizontal plane, and a ram block tool configured to be removably attached to the sliding mechanism and configured to engage and remove the ram block from the horizontal chamber, wherein the sliding mechanism comprises at least one rail that extends substantially perpendicular to the horizontal plane.

16. A blowout preventer (BOP) having a crane for moving a component of the BOP, the BOP comprising:

a ram body having a horizontal chamber containing a movable ram block;

a bonnet assembly releasably mounted to the ram body for closing the horizontal chamber; the crane comprising:

a supporting mechanism fixedly attached to the ram body;

an arm mechanism connected to the supporting mechanism and configured to move in a horizontal plane, the arm mechanism including a first arm configured to rotate in the horizontal plane;

a sliding mechanism connected to the arm mechanism and configured to move substantially perpendicular to the horizontal plane;

a circular bonnet tool configured to be removably attached to the sliding mechanism and configured to grab and support the bonnet assembly for service, and a ram block tool configured to removably attach the ram block to the sliding mechanism in lieu of the circular bonnet tool to remove the ram block from the ram body for service.

17. A crane for moving a component of a device, the crane comprising:

a supporting mechanism configured to be fixedly attached to the device;

an arm mechanism connected to the supporting mechanism and configured to move in a horizontal plane;

a sliding mechanism connected to the arm mechanism and configured to move substantially perpendicular to the horizontal plane; and a grabbing mechanism configured to be removably attached to the sliding mechanism and configured to grab the component of the device, wherein the sliding mechanism includes a plate having a slot, and the grabbing mechanism comprises a bolt having a head larger than the slot and at tool connected to the bolt, and wherein the tool includes, an external circular frame, plural bearings provided in the external circular frame and configured to rotationally hold a bonnet of the device, an internal circular frame configured such that the plural bearings are sandwiched between the external circular frame and the internal circular frame, and fixing parts attached to the external circular frame and configured to slide relative the external circular frame to fix the bonnet of the device.

* * * * *